US005393928A

United States Patent [19]

Cribb et al.

[11] Patent Number: 5,393,928

[45] Date of Patent: Feb. 28, 1995

[54] SHIELDED CABLE ASSEMBLIES

[75] Inventors: Richard M. Cribb, Florissant; Arthur R. Henn, St. Louis; Martin H. Wohl, Chesterfield, all of Mo.

[73] Assignee: Monsanto Company, St. Louis, Mo.

[21] Appl. No.: 21,504

[22] Filed: Feb. 19, 1993

[51] Int. Cl.[6] ..... H01B 7/34; D03D 3/00; D04H 1/00

[52] U.S. Cl. ..... 174/36; 174/35 R; 174/117 M; 174/109; 428/229; 428/263; 428/289

[58] Field of Search ..... 174/36, 35 R, 117 M, 174/109

[56] References Cited

U.S. PATENT DOCUMENTS

| | | | |
|---|---|---|---|
| 3,089,915 | 5/1963 | Plummer . | |
| 3,582,532 | 6/1971 | Plummer | 174/36 |
| 3,660,138 | 5/1972 | Gorrell | 117/35 V |
| 3,946,143 | 3/1976 | McLoughlin | 174/84 R |
| 4,016,356 | 4/1977 | McLoughlin | 174/35 R |
| 4,281,211 | 7/1981 | Tatum et al. | 174/36 |
| 4,375,009 | 2/1983 | Fearnside et al. | 174/36 |
| 4,376,229 | 3/1983 | Maul et al. | 174/35 R |
| 4,409,427 | 10/1983 | Plummer | 174/36 |
| 4,461,076 | 7/1984 | Plummer | 29/825 |
| 4,681,591 | 7/1987 | Okagasu et al. | 8/115.68 |
| 4,684,762 | 8/1987 | Gladfelter | 174/36 |
| 4,822,950 | 4/1989 | Schmitt | 174/36 |
| 4,865,892 | 9/1989 | Winfield et al. | 428/34.9 |
| 5,103,067 | 4/1992 | Aldissi | 174/36 |
| 5,132,490 | 7/1992 | Aldissi | 174/36 |
| 5,180,884 | 1/1993 | Aldissi | 174/36 |
| 5,216,202 | 6/1993 | Yoshida et al. | 174/36 |
| 5,262,591 | 11/1993 | Aldissi | 174/36 |
| 5,262,592 | 11/1993 | Aldissi | 174/36 |

FOREIGN PATENT DOCUMENTS

| | | | |
|---|---|---|---|
| 466725 | 6/1992 | Japan | H01B 7/06 |

*Primary Examiner*—Morris H. Nimmo
*Attorney, Agent, or Firm*—Thomas E. Kelley

[57] ABSTRACT

Lower weight shielded cable assemblies with an enhanced level of shielding effectiveness, e.g. in the range of 0.1 MHz to 20 GHz, comprising a core of at least one insulated conductor element overwrapped with metallized fabric, e.g. characterized as having a surface resistivity less than 100 milliohms/square or as being a metallized fabric coated with at least a layer of copper having a metal density of greater than 50 grams/square meter. Cable assemblies can employ a shielding subassembly comprising braided wire and one or more layers of copper-metallized fabric where the shielding subassembly has a transfer impedance at 10 MHz of less than 50 mo/m. For example, it has been found that cable assemblies employing a four layer wrap of certain metallized fabrics can provide up to 20 decibels improvement in shielding effectiveness over a wide range of frequencies with a 74 percent reduction in weight compared to a standard wire braid/foil laminate shield.

34 Claims, 14 Drawing Sheets

SHIELDED CABLE ASSEMBLIES

Disclosed herein are shielded cable assemblies using low weight, flexible shielding materials offering enhanced shielding effectiveness and methods of making and using such cable assemblies.

BACKGROUND OF THE INVENTION

Cable assemblies typically comprise one or more insulated conductors presented in a round bundle or in a flat ribbon. To avoid interference from electromagnetic radiation, commonly referred to as electromagnetic interference, EMI, and radio frequency interference, RFI, cable assemblies are overwrapped with a conductive shielding material, e.g. metal conduit, wire braid, metal foil, carbon-filled polymer or metallized fabric. A variety of shielding jackets for cables are disclosed in U.S. Pat. Nos. 3,089,915; 3,582,532; 4,281,211; 4,375,009; 4,376,229; 4,409,427; 4,461,076; 4,684,762 and Japanese Laid-Open Utility Model Application 4-66725. Shielding jackets for cable connectors and junctions are disclosed in U.S. Pat. Nos. 3,946,143; 4,016,356; and 4,865,892.

Wire braid is a common shielding material which is effective especially against low frequency interference. At high frequency, where the wavelength of the radiation begins to approach the size of the apertures in the shielding material, the leakage of radiation through apertures adversely affects shielding. Smaller apertures in braid are achieved by reducing wire size. However, minimum wire size is limited by the cost and difficulty of drawing fine wire. Consequently, braided wire shielding material, e.g. braid of 36 gauge tinned copper wire, begins to leak significantly at 1 to 10 megahertz (MHz).

In gigahertz range radar or in high speed data systems having fast rise time harmonics, there is a need to provide shielding effectiveness at both very low and very high frequencies with low weight materials. Often a combination of wire braid and metal foil is used to achieve the desired shielding with an undesirable weight of shielding materials. At higher frequencies, metal foils are especially effective in shielding where the shielding mechanisms are capacitive, inductive and reflective effects. Metal foils are difficult to produce in a low weight, flexible and durable thickness that is effective at both low and high frequencies. Thin metal foils are typically provided as laminates on a flexible plastic film. Overlapping seams of such laminates inherently allow leakage, e.g. with spiral wrapped shielding. Longitudinally wrapped metal foil laminates can be edge-folded to provide metal-metal contact reducing the leaking phenomena.

In many applications, e.g. in computer assemblies and aircraft, design of shielded cable assemblies often requires a compromise between desired level of shielding effectiveness and weight. An object of this invention is to provide lower weight shielded cable assemblies with an enhanced level of shielding effectiveness.

SUMMARY OF THE INVENTION

This invention provides shielded cable assemblies comprising a core of at least one insulated conductor element overwrapped with metallized fabric offering an enhanced level of shielding effectiveness, e.g. in the range of 0.1 to 1000 MHz and higher, for instance up to 20 gigahertz (GHz). This invention can be achieved by shielding cable assemblies with a metallized fabric having a surface resistivity less than 30 milliohms/square (mo/sq), e.g. fabric coated with silver or copper. Alternatively, the object of this invention can be achieved by shielding cable assemblies with a metallized fabric in which the substrate fibrous component is coated with at least one layer of metal providing a metal density of greater than 50 grams per square meter ($g/m^2$). In another aspect the cable assemblies of this invention employ a shielding subassembly comprising braided wire exhibiting transfer impedance of less than 50 milliohm/meter (mo/m) at 0.2 MHz and one or more layers of copper-metallized fabric selected so that the shielding subassembly has a transfer impedance at 10 MHz of less than 50 mo/m. A preferred aspect of this invention employs more than one layer of metallized fabric, e.g. one layer with 10 percent overlap or more, such as two to four layers. For example, it has been found that cable assemblies employing a four layer wrap of certain metallized fabrics can provide up to 20 decibels improvement in shielding effectiveness over a wide range of frequencies with a 74 percent reduction in weight compared to a standard wire braid/foil laminate shield.

Another aspect of this invention provides novel metallized fabric having at least one layer of metal on a fibrous substrate, said fabric being selected from the group consisting of (a) woven fabric having a surface resistivity less than 20 milliohms/square, (b) non-woven fabric having a surface resistivity less than 50 milliohms/square, and (c) woven or non-woven fabric having at least one layer of copper, preferably coated with a layer of silver, nickel or tin, and having a metal density greater than 50 grams/square meter ($g/m^2$).

DETAILED DESCRIPTION OF PREFERRED EMBODIMENTS

As used herein the term "transfer impedance" used in determining "shielding effectiveness" of a cable assembly is determined in accordance with the international specification IEC 96 as particularly set forth in Test Method MIL-C-85485A, paragraph 4.7.24 (1–4), incorporated herein by reference.

As used herein the term "shielding effectiveness" is determined from the algorithm $SE=20 \log (Zo/Z)$, where Z is the measured transfer impedance of a cable assembly and Zo is the test equipment input impedance. In certain uses of the term, shielding effectiveness is used to define an inherent property of a shielding material, e.g. in a designated geometric configuration; such inherent property is also determined in accordance with the MIL-C-85485A test protocol using a standard cable assembly comprising a 4.7 millimeter (3/16 inch) diameter, 4 conductor cable using the designated material for shielding.

As used herein the term "surface resistivity" refers to an intrinsic property of a metallized web, e.g. foil or fabric, measured with a four-point probe. Surface resistivity is represented in algorithms in the following description of the invention by the Greek letter rho ($\rho$) and is commonly reported in units Of ohms/square or as used herein milliohms/square (mo/sq).

Figure 1:
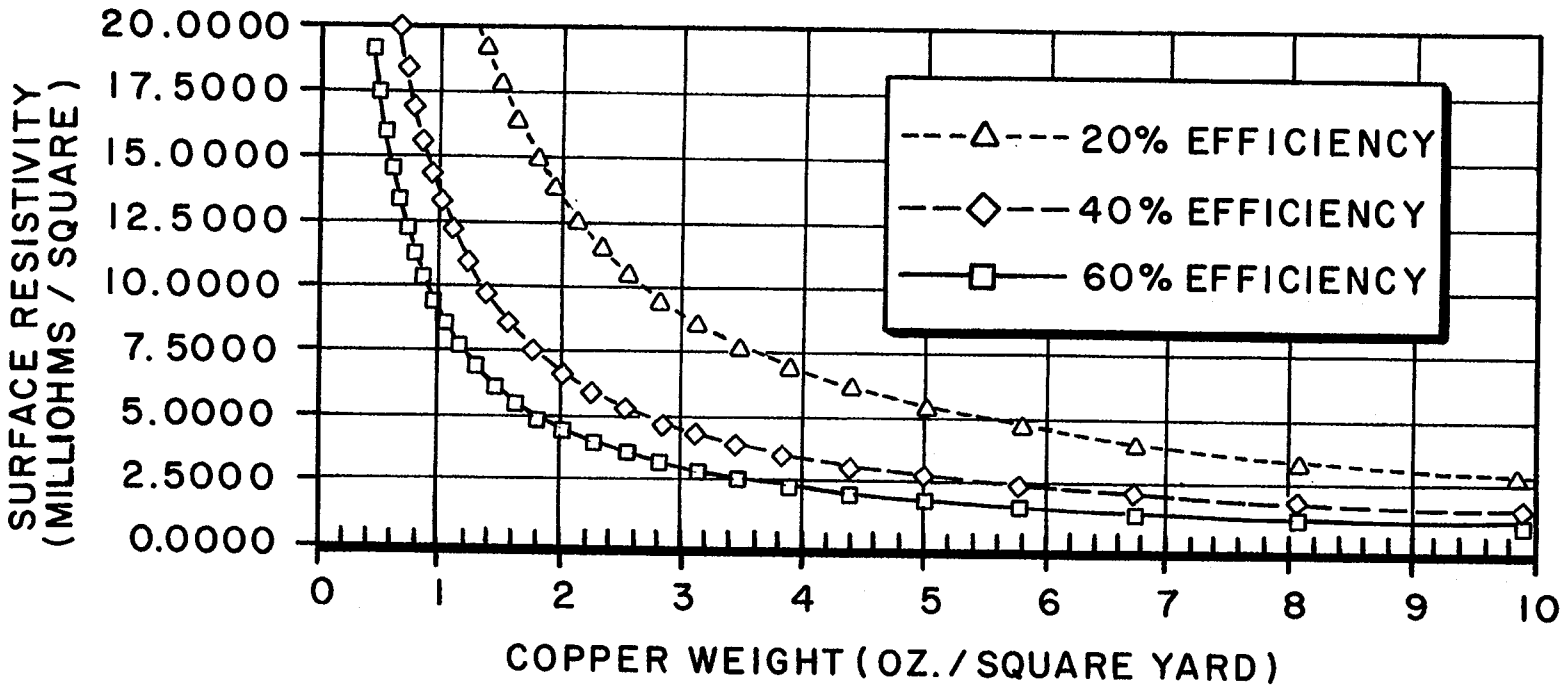
FIG. 1 illustrates a relationship among surface resistivity, metal density and fabric efficiency.

Electromagnetic radiation has two components, an electric field component and a magnetic field component. The impedance of the electric field component is typically orders of magnitude higher than the impedance of the magnetic field component. The mechanism for shielding of an electromagnetic wave, e.g. reflectance or absorption, depends in large part on the impedance difference between the wave component and the shielding material. Because electric field impedance is generally orders of magnitude higher than the impedance of metallized fabric shielding materials, electric fields are primarily attenuated by reflectance due to the impedance mismatch. In order to achieve shielding of magnetic energy, the resistivity of the shielding material must be reduced to a level below what is acceptable for attenuating an electric field to provide a sufficient impedance mismatch. In considering magnetic field shielding it is convenient to characterize metallized fabrics as analogous to metal foils, e.g. use the surface resistivity and metal density parameters to calculate an theoretical thickness of an equivalent metal foil. For instance, dividing the measured surface resistivity of a metallized fabric by the bulk resistivity of the metal provides a resistivity-based equivalent foil thickness. Similarly, dividing the metal weight of a fabric by the density of the metal provides an weight-based equivalent foil thickness. It is convenient to express the ratio of the resistivity-based equivalent foil thickness to the weight-based equivalent foil thickness to provide a "fabric efficiency" for comparing the fabric to a metal foil. Higher efficiency fabrics will exhibit a lower surface resistivity for a given weight of metal. In this regard see FIG. 1 illustrating the relationship among the variables of surface resistivity, metal weight and fabric efficiency for a copper-metallized fabric.

At low frequencies, e.g. in the range of 0.1 to 50 MHz, shielding effectiveness of a cable shielding material can be determined from the low frequency transfer impedance, Z, of the shielding material. Such transfer impedance is effectively related to the direct current (DC) resistance of the shielding material measured along the cable length. More particularly, such transfer impedance for metallized fabric is a function of shield geometry and its surface resistivity, has units of "ohms/meter" is calculated from the algorithm $$Z=\rho/(N\pi D), \text{ for round cable, or}$$

$$Z=\rho/(2N\ W), \text{ for planar ribbon cable,}$$

where N is the number of layers of metallized fabric around the cable assembly, D is round cable diameter and W is ribbon cable width. Knowing the test equipment input impedance, Zo, the "Shielding Effectiveness" SE of a shielded cable assembly can be determined from the algorithm SE=20 log (Zo/Z).

This invention provides shielded cable assemblies comprising a core of at least one insulated conductor element overwrapped with metallized fabric offering an enhanced level of shielding effectiveness, e.g. in the range of 0.1 to 1000 MHz. This invention can be achieved by shielding cable assemblies with a metallized fabric having a Surface resistivity less than 100 mo/sq, preferably less than 50 mo/sq, even more preferably less than 30 mo/sq. Especially preferred novel shielding materials are metallized woven fabrics having a surface resistivity less than 20 mo/sq and metallized non-woven fabrics having a surface resistivity less than 50 mo/sq. In especially preferred shielded cable the metallized fabric will have a surface resistivity less than 20 mo/sq, e.g. less than 10 mo/sq, most preferably less than 5 mo/sq. Lower resistivity is more advantageously achieved with a metal having relatively high intrinsic conductivity, e.g. silver or copper. Metal can be applied to textile substrates by a variety-of methods known in the art, preferably by electroless deposition, electrolytic deposition or vacuum deposition. Useful electroless deposition methods are disclosed by Vaughn in U.S. Pat. No. 5,082,734, incorporated herein by reference. Multiple metal layers may be useful, e.g. a base layer of copper, followed by a layer of cobalt, silver, nickel, tin and/or aluminum. Preferred metallized fabric comprises at least one layer of copper coated with a layer of nickel, silver or tin, where the copper is at least 25 percent by weight of the metal on the fabric, more preferably at least 50 percent or higher, say at least about 75 percent, of the metal on the fabric.

Alternatively, the object of this invention can be achieved by shielding cable assemblies with a metallized fabric in which the fibrous component is coated with at least a layer of metal having a metal density of greater than 50 grams per square meter ($g/m^2$), more preferably greater than 70 $g/m^2$, even more preferably greater than 100 $g/m^2$. In some cases it may be desirable to employ an even higher metal density, e.g. greater than 200 $g/m^2$ or higher such as greater than 300 $g/m^2$. Such high metal densities tend to reduce the flexibility of woven fabrics such as ripstop and taffeta and thin non-woven fabrics. Flexibility with high metal densities is more likely to be retained on high loft fabrics such as spun lace.

Accordingly, another aspect of this invention comprises metallized fabrics which are useful as shielding materials because they comprise at least one layer of copper and have a metal density greater than 50 grams/square meter.

As is illustrated in the following examples, braided wire is an especially effective shielding material against lower frequencies but not higher frequencies. It has been discovered that effective cable assemblies can be provided by employing a shielding subassembly comprising braided wire exhibiting transfer impedance of less than 50 mo/m at 0.2 MHz, preferably less than 25 mo/m, and one or more layers of metallized fabric selected so that the shielding subassembly has a transfer impedance at 10 MHz of less than 50 mo/m, more preferably less than 25 mo/m, even more preferably less than 10 mo/m, still more preferably less than 5 mo/m and most preferably less than 2 mo/m. Preferred metallized fabric for use with wire braid includes copper-coated fabric, especially multiply coated metal layers of copper and a layer of silver, nickel or tin.

For effective shielding metallized fabric should be applied to cable assemblies employing well-known configurations, e.g. Spiral wrap or longitudinal wrap (also known as cigarette wrap). Preferred cable assemblies employ at least two layers of metallized fabric shielding, e.g. spiral wrap with a 50% overlap or double longitudinal wrap. The advantages of low weight and high shielding effectiveness are illustrated in the following examples. For instance, it has been found that cable assemblies employing a four layer wrap of certain metallized fabrics can provide up to 20 decibels improvement in shielding effectiveness over a wide range of frequencies with a 74 percent reduction in weight compared to a standard wire braid/foil laminate shield.

Figure 2:
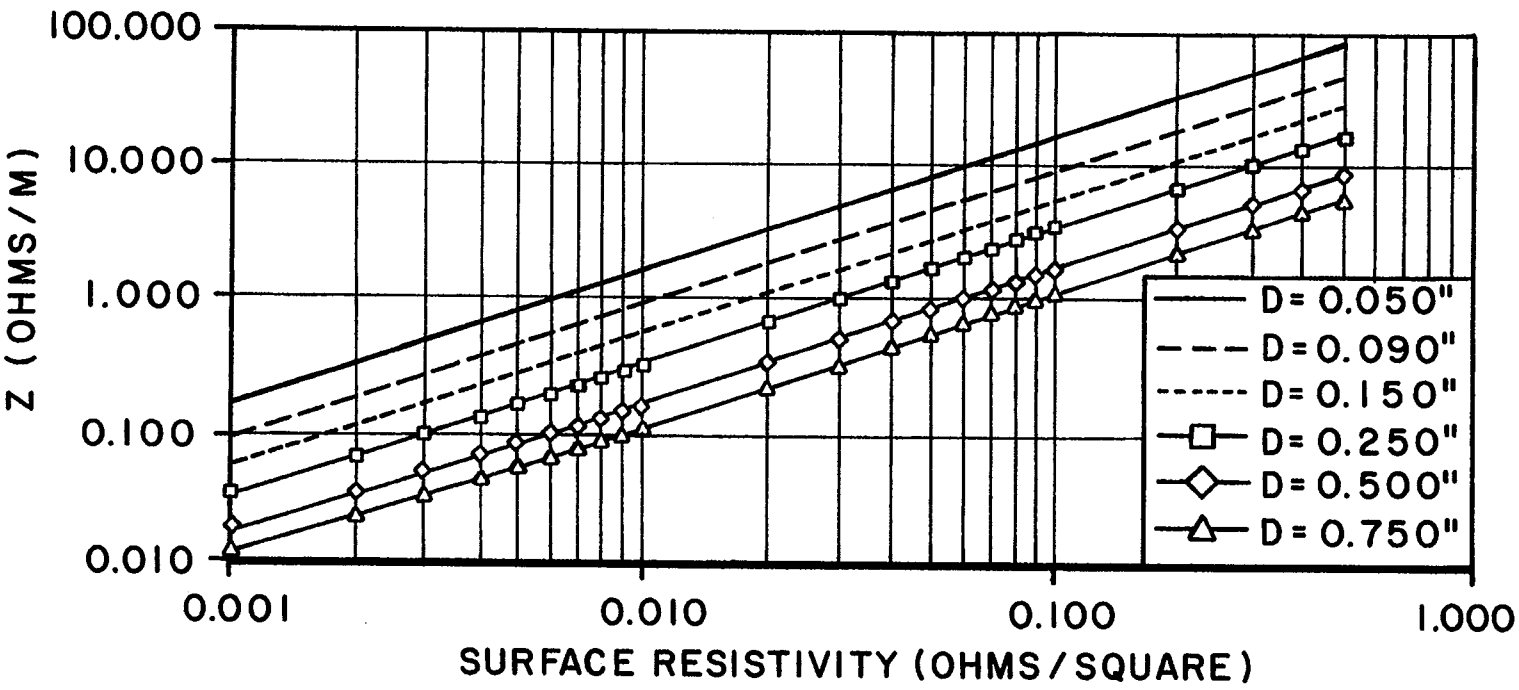
FIG. 2 illustrates that transfer impedance, Z, of shielding for round cable is related to cable diameter, D, and surface resistivity, $\rho$, of the shielding material.
Figure 3:
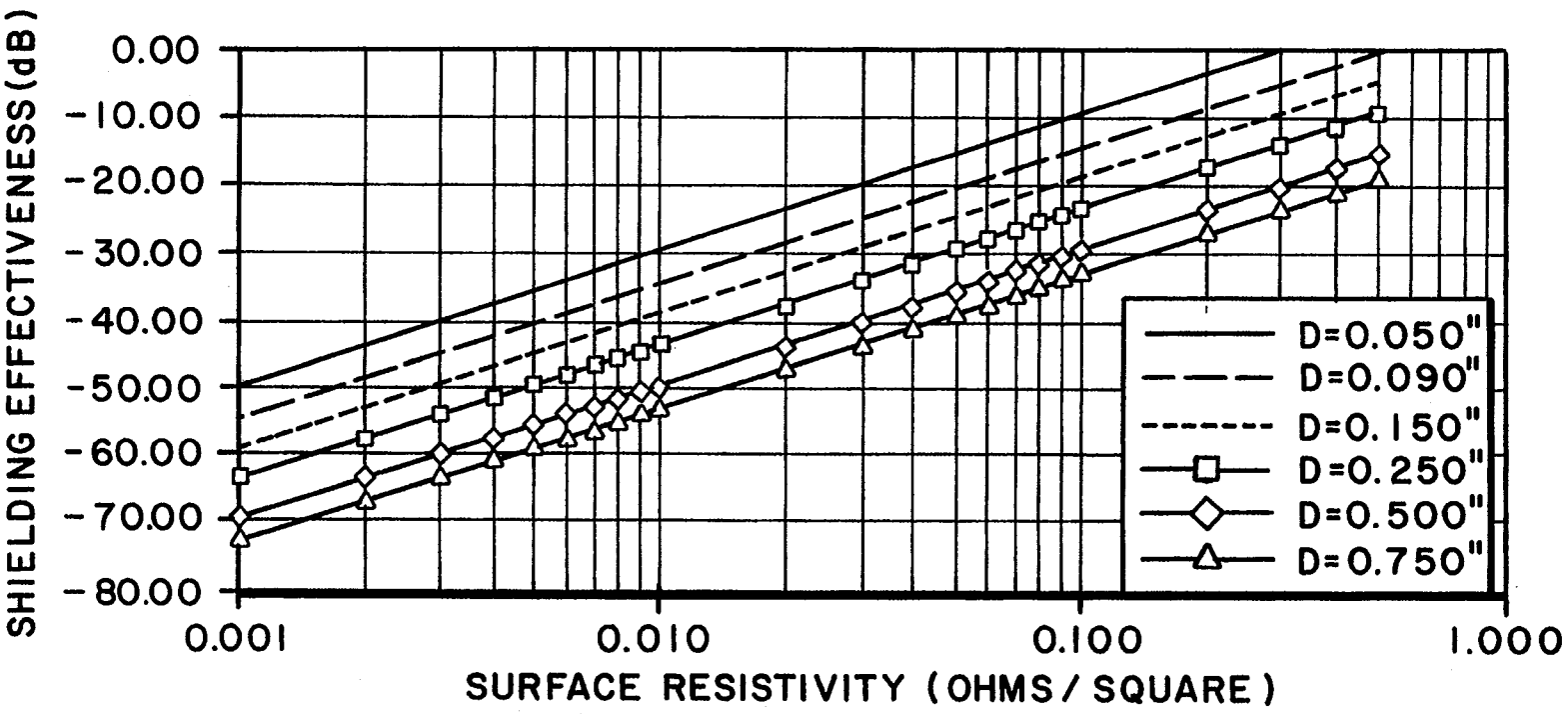
FIGS. 3 and 4 illustrate that shielding effectiveness, SE, at low frequencies, e.g. below 1 MHz, is related to surface resistivity of the shielding material and cable geometry.
Figure 4:
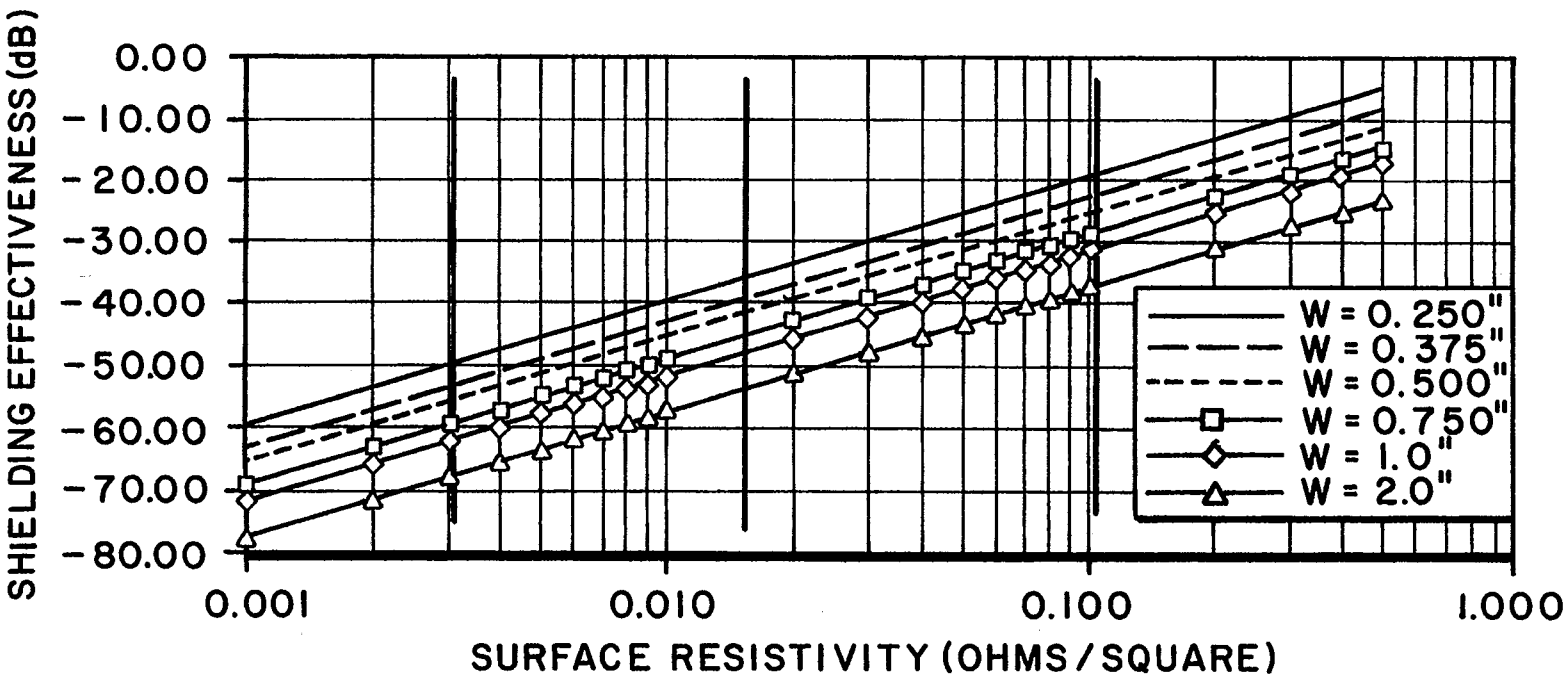

The theoretical shielding effectiveness, SE, at low frequency, e.g. up to 1 MHz, for round cable which is coaxially wrapped with one or more layers of shielding material, e.g. spirally with 50% overlap or double wrapped longitudinally, can be determined from the corresponding transfer impedance of the shielding material. As illustrated in FIG. 2, transfer impedance, Z, can be calculated for a variety of cable diameters, D, and surface resistivity, $\rho$, of the shielding material using the equation $Z=\rho/N\pi D$, where N is 2 for double wrapped shielding material. As illustrated in FIG. 3, shielding effectiveness, SE, assuming a test equipment impedance, Zo, of 50 ohms, is directly determined as a logarithmic function (base 10) of transfer impedance using the algorithm $SE=20 \log (Zo/Z)$. FIG. 3.suggests that better shielding can be achieved with larger cable diameters and use of shielding material of lower surface resistivity. In the case of braid or metallized fabric, lower surface resistivity can be designed into shielding material by using metals of intrinsically higher conductivity, e.g. copper instead of nickel, and by selecting a shielding material with a higher metal density per unit area. Similarly, the theoretical low frequency shielding effectiveness, SE, at low frequency, e.g..up to 1 MHz, for flat ribbon double wrapped with shielding material can be calculated from the algorithm $Z=\rho/(2 N W)$. As illustrated in FIG. 4, shielding effectiveness, assuming a baseline impedance of 50 ohms, can be represented as a function of surface resistivity of the shielding material and ribbon width, W. Better shielding can be achieved with wider ribbon cables and shielding material of lower surface resistivity. As in-the case of round coaxial cable, lower surface resistivity can be designed into shielding material by using metals of intrinsically higher conductivity, e.g. copper instead of nickel, and by selecting a shielding material with a higher metal density per unit area.

Example 1

In this example the metallized fabrics which are identified in Table 1 and which are useful for shielding cable assemblies were evaluated for shielding effectiveness against magnetic fields. Data reported in Table 1 shows a surprisingly substantially enhanced shielding effectiveness at low frequency, i.e. 1 MHz, as compared to modestly enhanced shielding effectiveness at higher frequency, i.e. 10 Mhz. The improvements in shielding effectiveness are achieved by significantly lowering the surface resistivity of a copper-metallized fabric, e.g. by providing a substantially higher level of metal coating on the substrate fabric. Nonetheless, it is noted that there is only a modest increase in fabric efficiency, e.g. believed to result from the higher amount of metal bridging at fiber crossover points reducing contact resistance.

TABLE 1

| Base Fabric | Metal[1] | $\rho$[2] | FE[3] | Magnetic Field Shielding Effectiveness 1 MHz | 5 MHz | 10 Mhz |
|---|---|---|---|---|---|---|
| A | 6 | 72 | 38 | 1 | 5 | 10 |
| A | 62 | 5 | 48 | 13 | 27 | 33 |
| B | 14 | 36 | 31 | 2 | 11 | 16 |
| B | 74 | 6 | 36 | 15 | 28 | 36 |
| C | 47 | 34 | 10 | 3 | 15 | 21 |
| C | 180 | 4 | 22 | 20 | 36 | 46 |

A: 37 g/m$^2$ base weight nylon ripstop fabric
B: 42 g/m$^2$ base weight PET non-woven fabric
C: 68 g/m$^2$ base weight PET spunlace non-woven fabric
[1]metal density in g/m$^2$
[2]$\rho$ is surface resistivity in milliohms/square
[3]FE is fabric efficiency

Examples 2–6

These examples illustrate the effectiveness of a variety of shielding materials on a 4.7 mm (3/16 inch) diameter, 4 conductor cable using the following materials for shielding:

CWB: a 36 gauge tinned copper wire braid

Al-Foil: a 75 micrometer (3 mil) thick laminate of aluminum foil on PET film having density of 99 g/m$^2$, a metal content of 25 weight percent (wt %), and a surface resistivity of 3.5 milliohms/square.

Cu-RS: a 100 micrometer (4 mil) thick copper-metallized nylon ripstop fabric having a density of 102 g/m$^2$, a metal content of 60 weight percent (wt %), and a surface resistivity of 5.2 milliohms/square.

Cu-NW: a 325 micrometer (13 mil) thick copper-metallized polyester (PET) non-woven fabric having a density of 119 g/m$^2$, a metal content of 63 weight percent (wt %), and a surface resistivity of 5.8 milliohms/-square.

Cu-SL: a 475 micrometer (19 mil) thick copper-metallized polyester (PET) spunlace fabric having a density of 272 g/m$^2$, a metal content of 75 weight percent (wt %), and a surface resistivity of 4 milliohms/square.

Test Cable: a 4.7 millimeter diameter four conductor cable.

Test Method: MIL-C-85485A. paragraphs 4.7.24 (1–4) over the frequency range of 0.1 to 1000 MHz. Graphical representations of shielding properties typically show the following parameters, Power Level S in units of decibels, Transfer Impedance in units of ohms/meter and Shielding Effectiveness in units of decibels.

Example 2

Figure 5A:
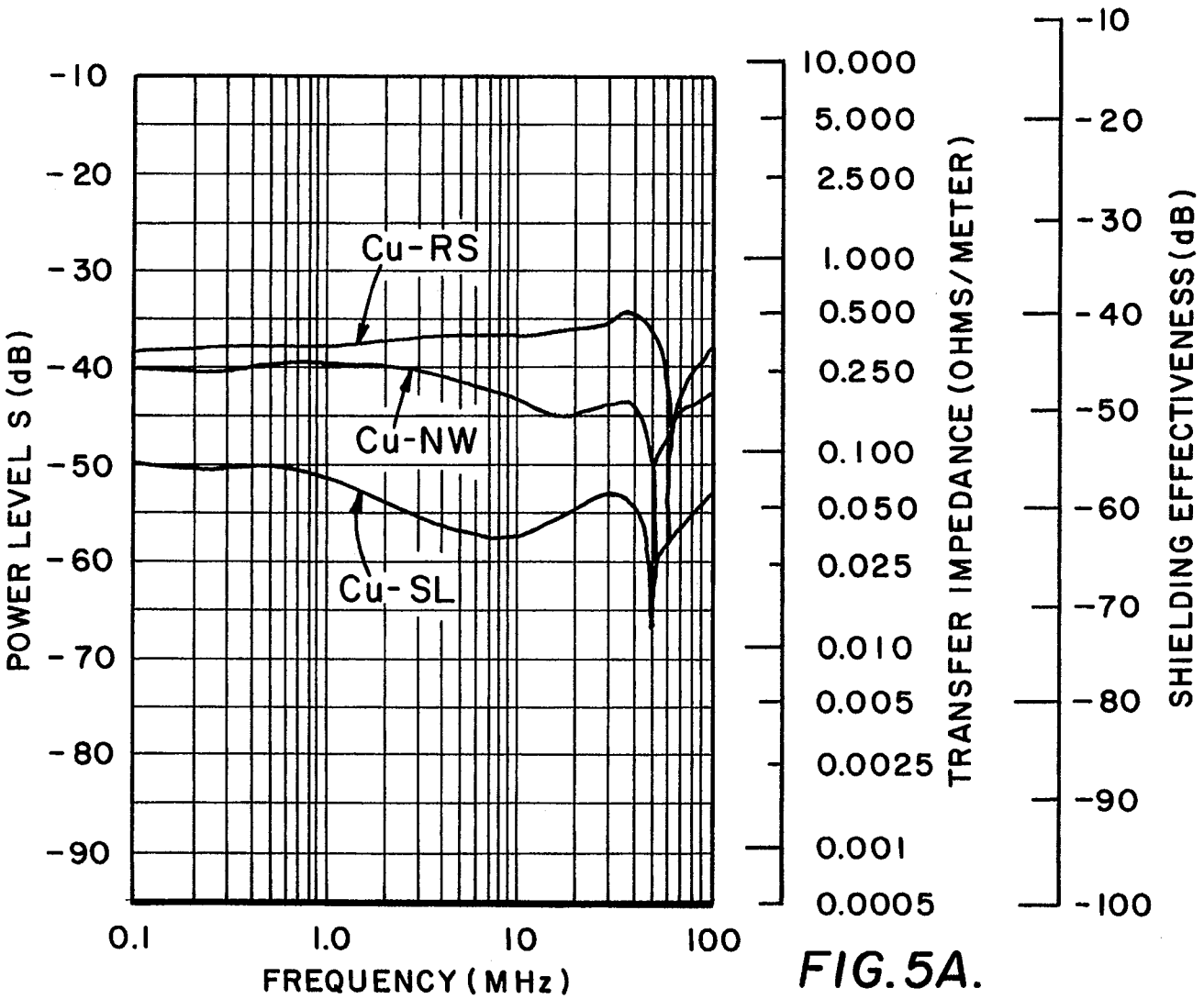
FIGS. 5A and 5B illustrate shielding properties of three metallized fabrics useful in the cable assemblies of this invention.
Figure 5B:
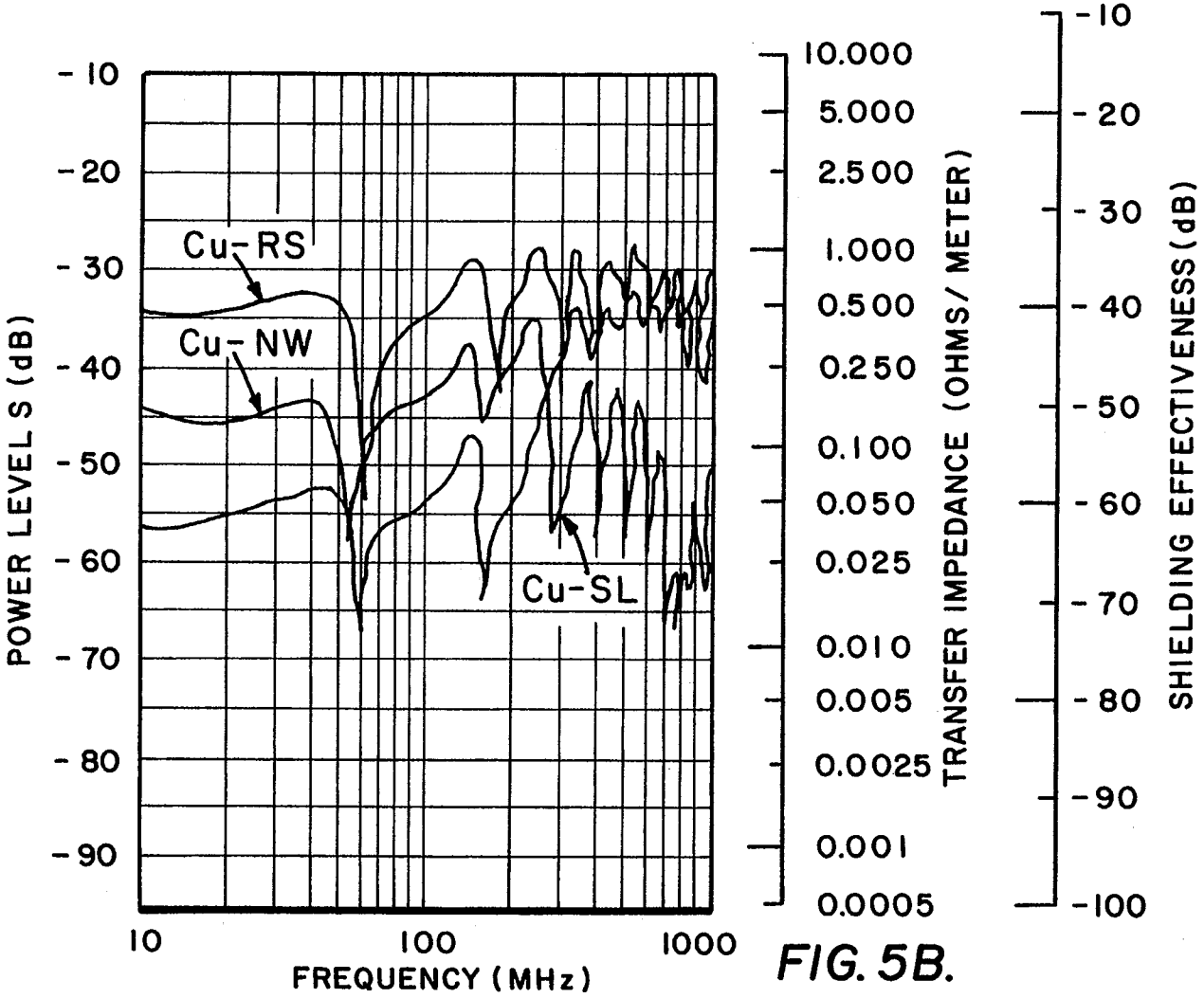

Shielding materials comprising Cu-RS, Cu-NW and Cu-SL Fabrics were applied in a two layer longitudinal wrap on Test Cable and evaluated for shielding properties shown in FIGS. 5A and 5B.

Example 3

Figure 6A:
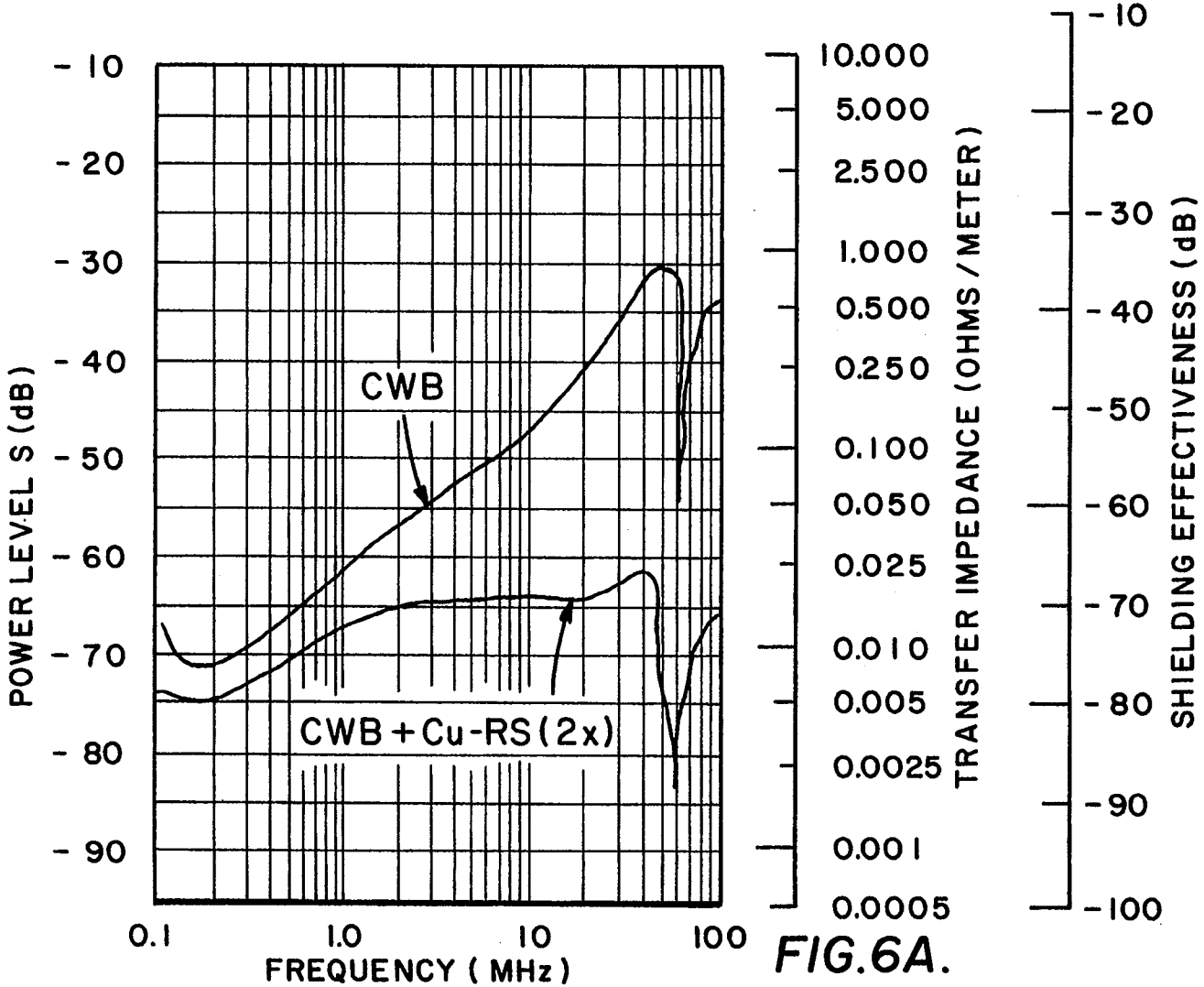
FIGS. 6A and 6B, 7A and 7B, 8A and 8B, and 9A and 9B illustrate the improvements in shielding effectiveness of metallized fabric shielding of this invention as compared to a common shielding materials.
Figure 6B:
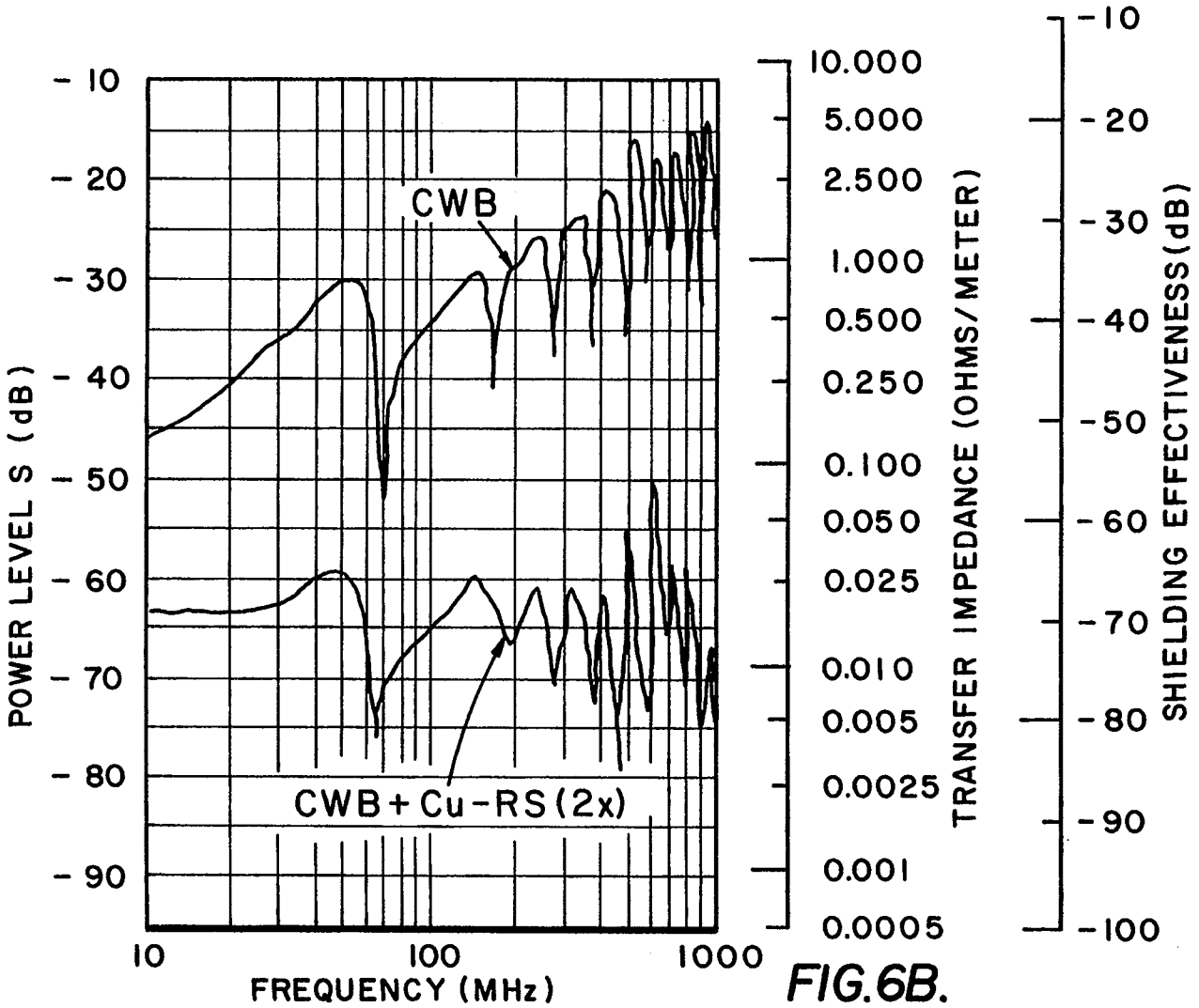

Shielding materials Comprising CWB wire braid and Cu-RS (a two layer longitudinal wrap) were applied to Test Cable and evaluated for shielding properties shown in FIGS. 6A and 6B. The metallized fabric provides about a 30 decibel gain in shielding effectiveness at frequencies of 50 MHz and higher with only about a 13 percent weight increase.

Example 4

Figure 7A:
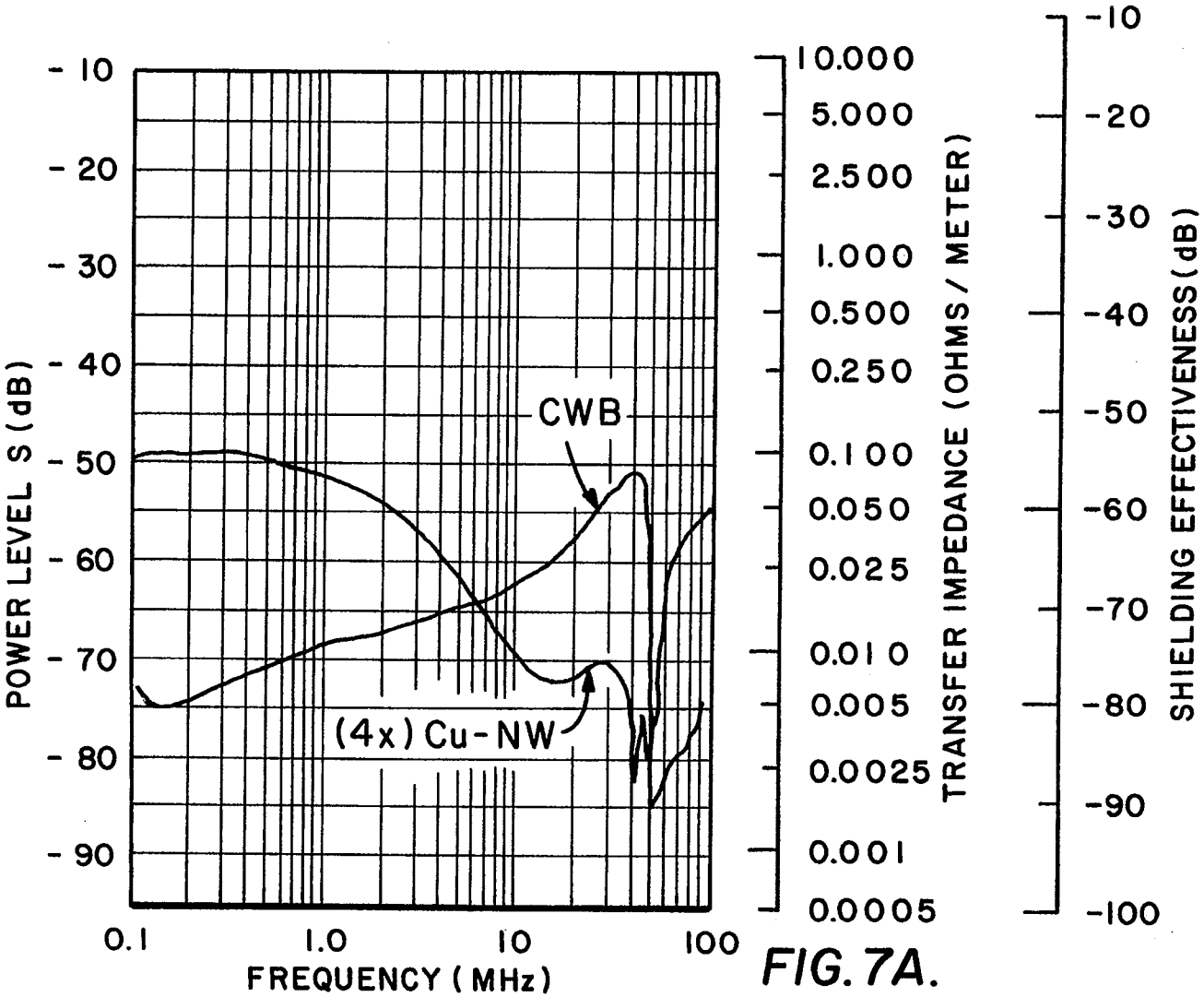
Figure 7B:
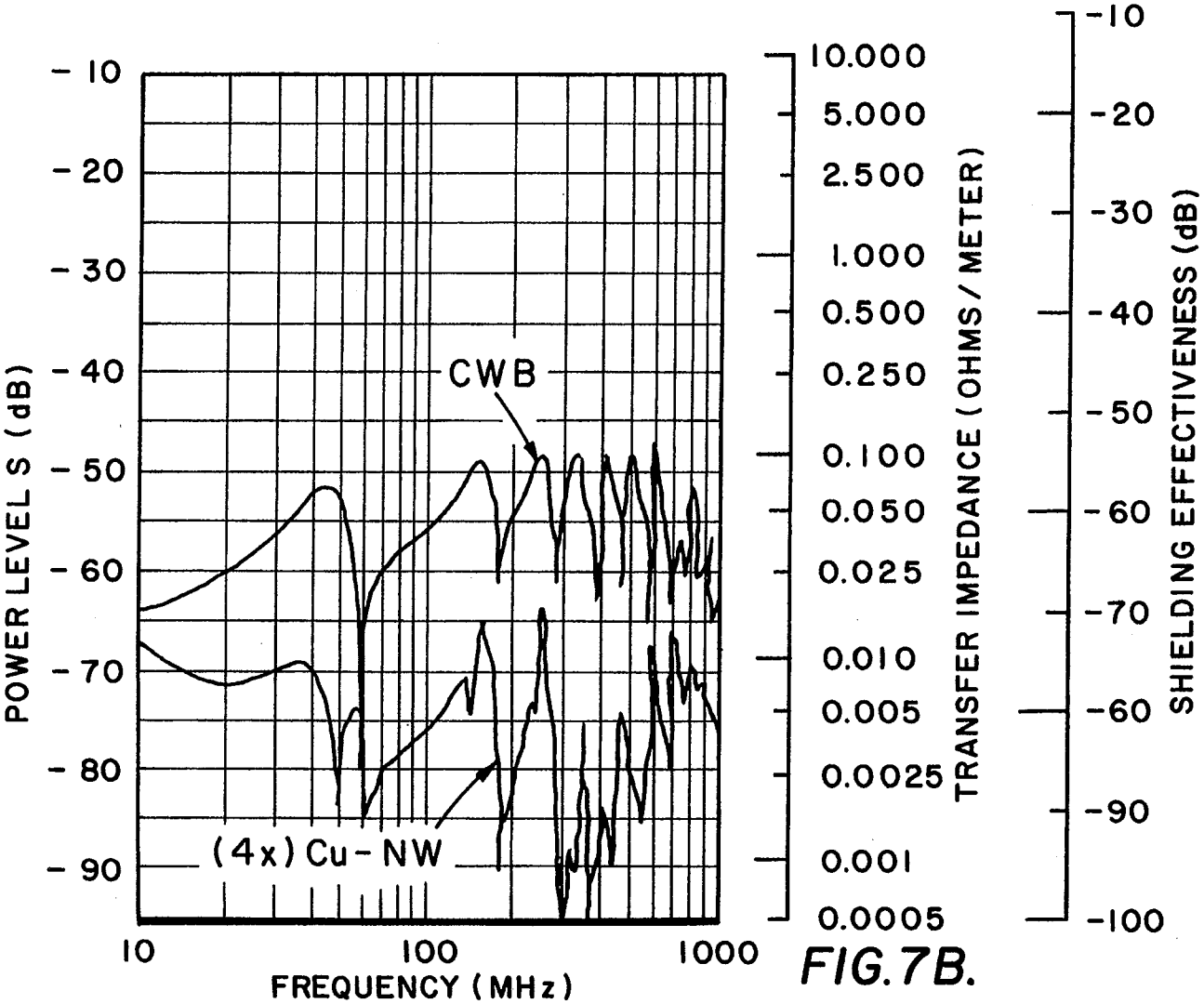

Shielding materials comprising a combination of CWB wire braid with Al-foil (longitudinally wrapped with a shorting fold to avoid a waveguide leak) and Cu-NW (in a four layer longitudinal wrap) were applied to Test Cable and evaluated for shielding properties shown in FIGS. 7A and 7B. The metallized fabric provides about a 20 decibel gain in shielding effectiveness at frequencies above 10 MHz with about a 74 percent weight reduction.

Example 5

Figure 8A:
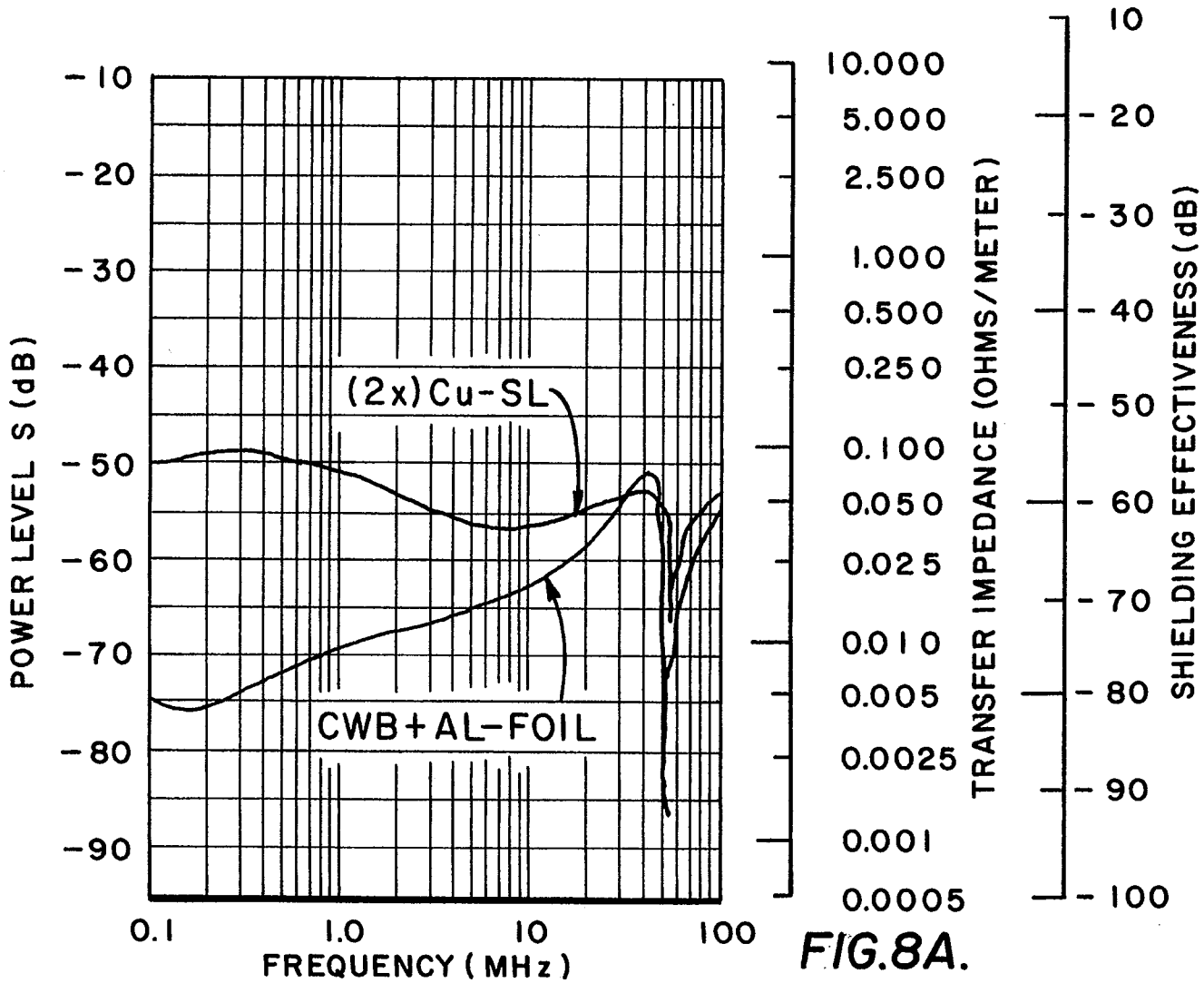
Figure 8B:
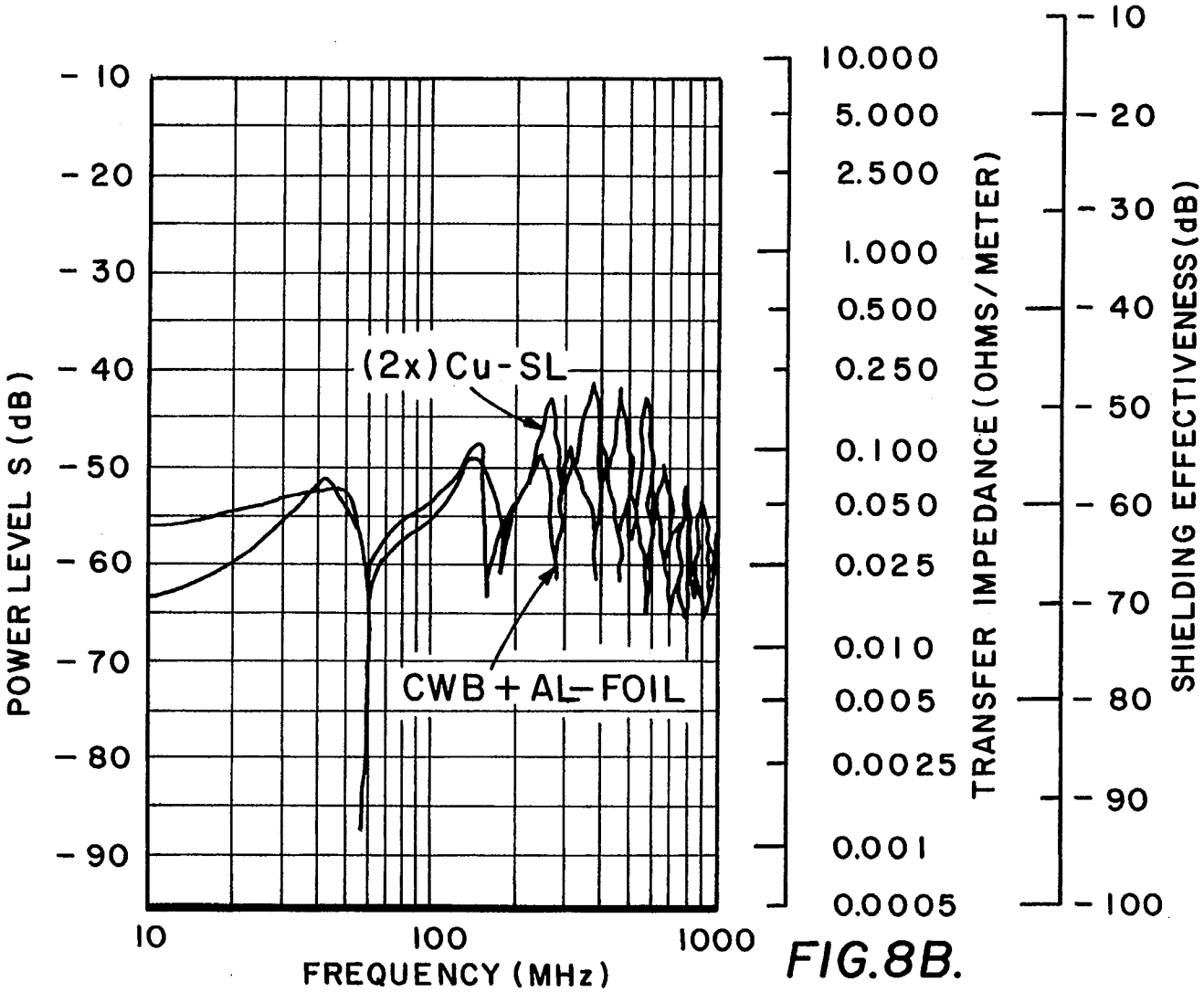

Shielding materials comprising a combination of CWB wire braid with Al-foil (longitudinally wrapped with a shorting fold to avoid a waveguide leak) and Cu-SL (in a two layer longitudinal wrap) were applied to Test Cable and evaluated for shielding properties shown in FIGS. 8A and 8B. The metallized fabric provides about the same shielding effectiveness at frequencies above.30 MHz with about a 70 percent weight reduction.

Example 6

Figure 9A:
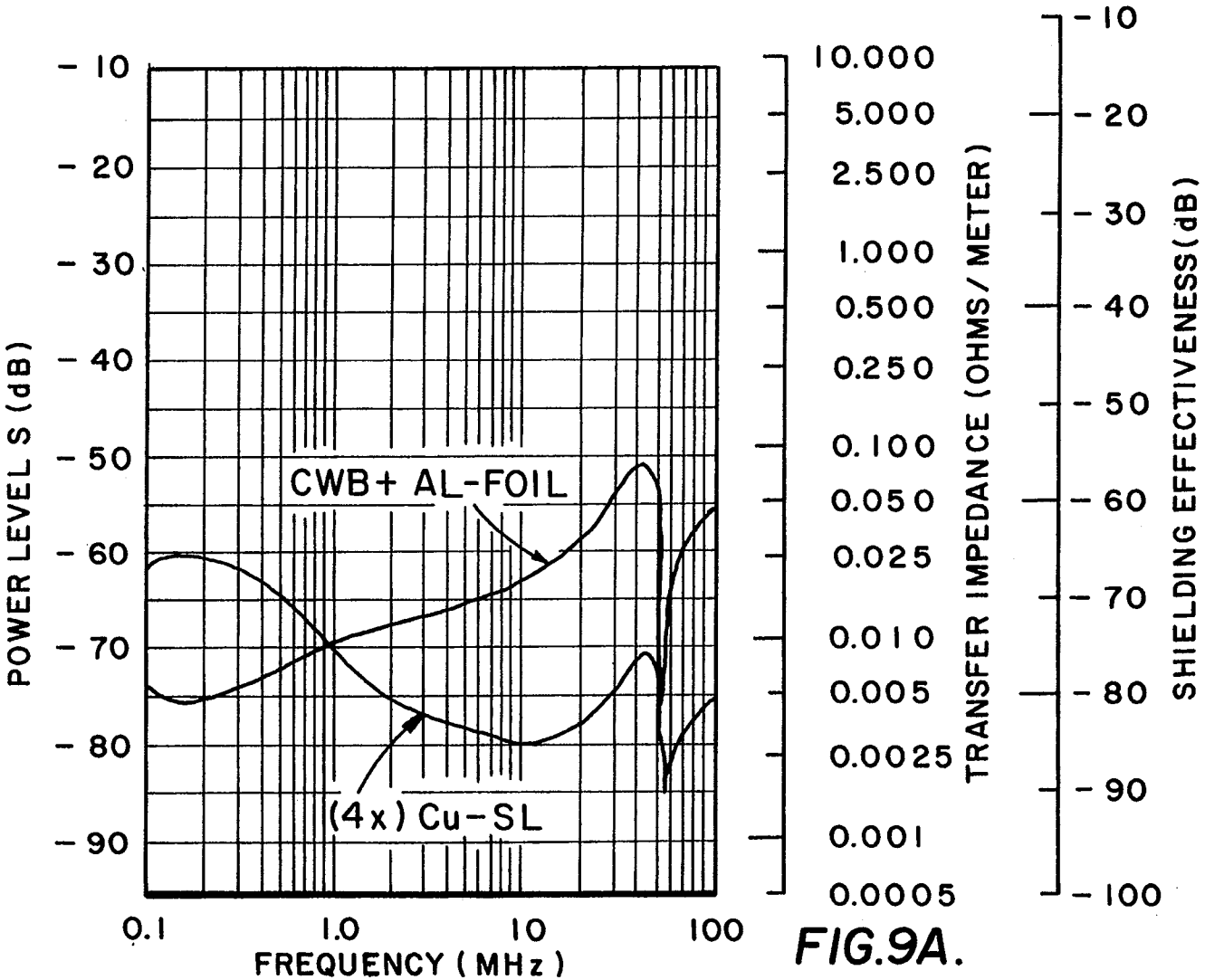
Figure 9B:
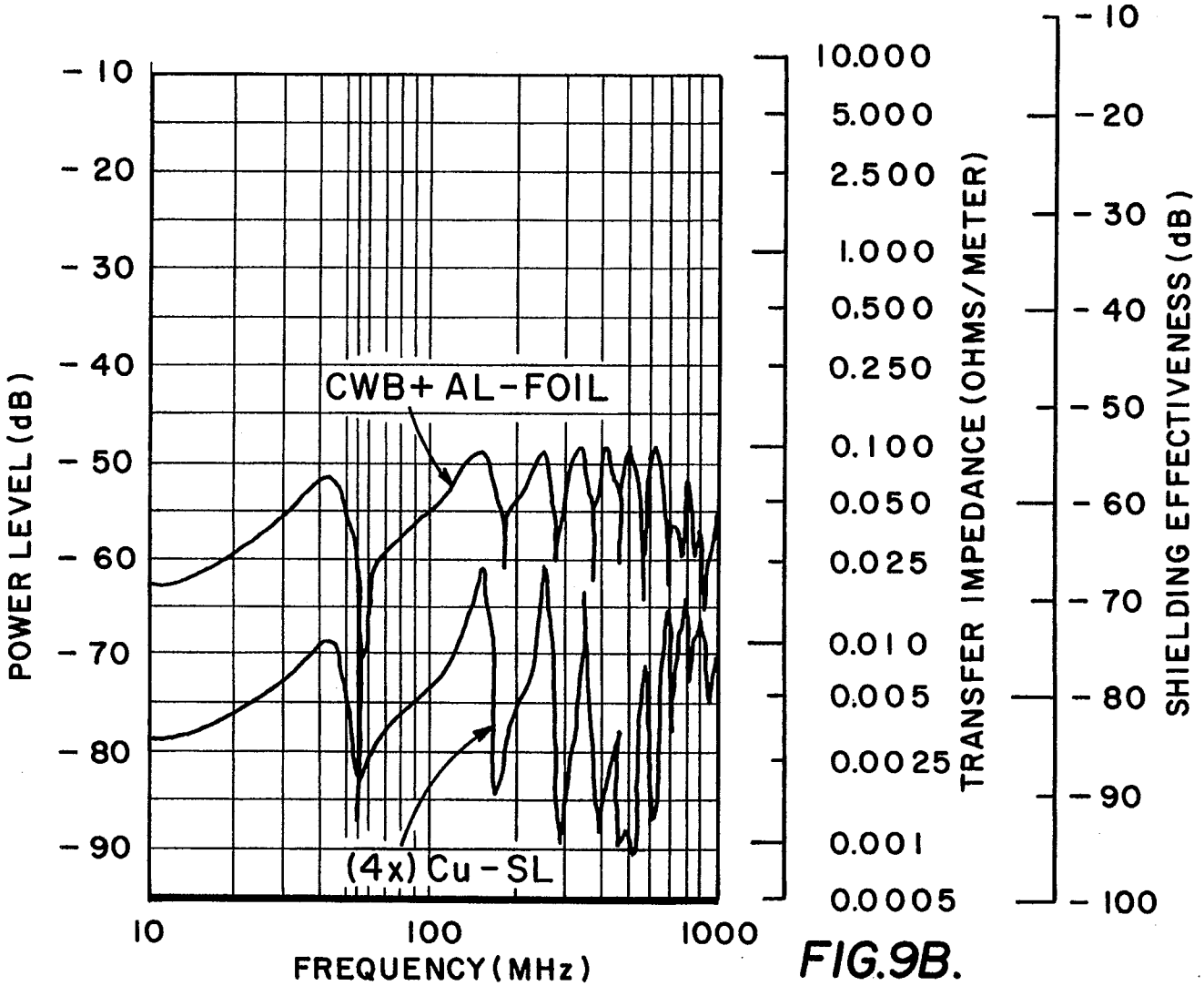

Shielding materials comprising a combination of CWB wire braid with Al-foil (longitudinally wrapped with a shorting fold to avoid a waveguide leak) and Cu-SL (in a four layer longitudinal wrap) were applied to Test Cable and evaluated for shielding properties shown in FIGS. 9A and 9B. The metallized fabric provides about a 20 decibel gain in shielding effectiveness at frequencies above 10 MHz with about a 28 percent weight reduction.

While specific embodiments have been described herein, it should be apparent to those skilled in the art that various modifications thereof can be made without departing from the true spirit and scope of the invention. Accordingly, it is intended that the following claims cover all such modifications within the full inventive concept.

What is claimed is:

1. An elongated shielded cable assembly comprising a core of at least one insulated conductor element overwrapped with more than one layer of metallized fabric, wherein said fabric has a surface resistivity less than 100 milliohms/square.

2. A shielded cable assembly according to claim 1 wherein said fabric has a surface resistivity less than 50 milliohms/square.

3. A shielded cable assembly according to claim 2 wherein said fabric has a surface resistivity less than 30 milliohms/square.

4. A shielded cable assembly according to claim 3 wherein said fabric has a surface resistivity less than 20 milliohms/square.

5. A shielded cable assembly according to claim 4 wherein said fabric has a surface resistivity less than 10 milliohms/square.

6. A shielded cable assembly according to claim 5 wherein said fabric has a surface resistivity less than 5 milliohms/square.

7. A shielded cable assembly comprising a core of at least one insulated conductor element overwrapped with more than one layer of metallized fabric, wherein said fabric is coated with at least a layer of copper having a metal density of greater than 50 grams per square meter.

8. A shielded cable assembly according to claim 7 wherein said fabric is coated with at least a layer of copper having a metal density of greater than 70 grams per square meter.

9. A shielded cable assembly according to claim 8 wherein said fabric is coated with at least a layer of copper having a metal density of greater than 100 grams per square meter.

10. A shielded cable assembly according to claim 9 wherein said fabric is coated with at least a layer of copper having a metal density of greater than 200 grams per square meter.

11. A shielded cable assembly according to claim 10 wherein said fabric is coated with at least a layer of copper having a metal density of greater than 300 grams per square meter.

12. A shielded cable assembly comprising a core of at least one insulated conductor element overwrapped a shielding subassembly comprising braided wire exhibiting transfer-impedance of less than 50 milliohms/meter at 0.2 MHz and one or more layers of copper-metallized fabric selected so that the shielding subassembly has a transfer impedance at 10 MHz of less than 50 milliohms/meter.

13. A shielded cable assembly according to claim 12 wherein said subassembly has a transfer impedance at 10 MHz of less than 25 milliohms/meter.

14. A shielded cable assembly according to claim 13 wherein said subassembly has a transfer impedance at 10 MHz of less than 10 milliohms/meter.

15. A shielded cable assembly according to claim 14 wherein said subassembly has a transfer impedance at 10 MHz of less than 5 milliohms/meter.

16. A shielded cable assembly according to claim 15 wherein said subassembly has a transfer impedance at 10 MHz of less than 2 milliohms/meter.

17. Metallized fabric having at least one layer of metal on a fibrous substrate, said fabric being selected from the group consisting of (a) woven fabric having a surface resistivity less than 20 milliohms/square, (b) non-woven fabric having a surface resistivity less than 50 milliohms/square and (c) woven or non-woven fabric having at least one layer of copper and a metal density greater than 50 grams/square meter.

18. Metallized fabric according to claim 17 wherein said at least one layer of metal comprises a layer of copper coated with a layer of nickel, silver or tin and wherein said layer of copper is at least 25 percent by weight of the metal on said fabric.

19. A metallized fabric according to claim 17 wherein said fabric is a woven fabric having a surface resistivity of less than 10 milliohms/square.

20. A metallized fabric according to claim 19 wherein said fabric is a woven fabric having a surface resistivity of less than 5 milliohms/square.

21. A metallized fabric according to claim 18 wherein said fabric is a woven fabric having a surface resistivity of less than 10 milliohms/square.

22. A metallized fabric according to claim 21 wherein said fabric is a woven fabric having a surface resistivity of less than 5 milliohms/square.

23. A metallized fabric according to claim 17 wherein said fabric is a nonwoven fabric having a surface resistivity of less than 30 milliohms/square.

24. A metallized fabric according to claim 23 wherein said fabric is a nonwoven fabric having a surface resistivity of less than 20 milliohms/square.

25. A metallized fabric according to claim 24 wherein said fabric is a nonwoven fabric having a surface resistivity of less than 10 milliohms/square.

26. A metallized fabric according to claim 25 wherein said fabric is a nonwoven fabric having a surface resistivity of less than 5 milliohms/square.

27. A metallized fabric according to claim 18 wherein said fabric is a nonwoven fabric having a surface resistivity of less than 30 milliohms/square.

28. A metallized fabric according to claim 27 wherein said fabric is a nonwoven fabric having a surface resistivity of less than 20 milliohms/square.

29. A metallized fabric according to claim 28 wherein said fabric is a nonwoven fabric having a surface resistivity of less than 10 milliohms/square.

30. A metallized fabric according to claim 29 wherein said fabric is a nonwoven fabric having a surface resistivity of less than 5 milliohms/square.

31. A metallized fabric according to claim 17 wherein said fabric has at least one layer of copper and a metal density greater than 70 grams/square meter.

32. A metallized fabric according to claim 31 wherein said fabric has at least one layer of copper and a metal density greater than 100 grams/square meter.

33. A metallized fabric according to claim 32 wherein said fabric has at least one layer of copper and a metal density greater than 200 grams/square meter.

34. A metallized fabric according to claim 33 wherein said fabric has at least one layer of copper and a metal density greater than 300 grams/square meter.

* * * * *